United States Patent [19]

Murata et al.

[11] Patent Number: 4,871,119

[45] Date of Patent: Oct. 3, 1989

[54] IMPACT CRUSHING MACHINE

[75] Inventors: Hiroyuki Murata, Kobe; Takeshi Tanaka, Kure; Chouji Hino, Kobe; Harunaga Kiuchi, Kure; Masahiro Chiji, Akashi, all of Japan

[73] Assignee: Kabushiki Kaisha Kobe Seiko Sho, Kobe, Japan

[21] Appl. No.: 164,181

[22] Filed: Mar. 4, 1988

[30] Foreign Application Priority Data

| | | | |
|---|---|---|---|
| Mar. 6, 1987 | [JP] | Japan | 62-32838 |
| Mar. 6, 1987 | [JP] | Japan | 62-32839 |
| Jul. 10, 1987 | [JP] | Japan | 62-173673 |
| Jul. 10, 1987 | [JP] | Japan | 62-106894 |

[51] Int. Cl.[4] ..... B02C 13/28

[52] U.S. Cl. ..... 241/189 R; 241/197; 241/300

[58] Field of Search ..... 241/300, 119 R, 197

[56] References Cited

U.S. PATENT DOCUMENTS

| | | | |
|---|---|---|---|
| 3,642,214 | 2/1972 | Blackwell | 241/197 X |
| 4,162,770 | 7/1979 | Lewis | 241/197 X |
| 4,717,083 | 1/1988 | Quast et al. | 241/197 |

FOREIGN PATENT DOCUMENTS

| | | | |
|---|---|---|---|
| 621949 | 10/1935 | Fed. Rep. of Germany | 241/197 |
| 15079 | 1/1983 | Japan . | |
| 174245 | 10/1983 | Japan . | |
| 388337 | 2/1933 | United Kingdom . | |
| 1456734 | 11/1976 | United Kingdom . | |

*Primary Examiner*—Mark Rosenbaum

*Attorney, Agent, or Firm*—Oblon, Spivak, McClelland, Maier & Neustadt

[57] ABSTRACT

An impact crushing machine provided with easily repairable strikers fixedly arranged along the circumference of a rotor at regular angular intervals so as to extend radially of the rotor. A plurality of seats fixedly mounted respectively with striking chips formed of a durable hard material such as a hard metal are arranged in lines and rows on and detachably fixed to the radially outer end of the striker for individual replacement. When the striking chip is abraded to an unusable extent, the seat mounted with the worn striking chip and a seat fixedly mounted with an unworn striking chip can be interchanged for the further use of the striker, so that the frequency of replacing the heavy striker with a new one is reduced and the operating cost of the impact crushing machine is reduced.

4 Claims, 15 Drawing Sheets

(a)

(b)

(a)

(b)

FIGURE 22(a)
PRIOR ART
FIGURE 22(b)
PRIOR ART
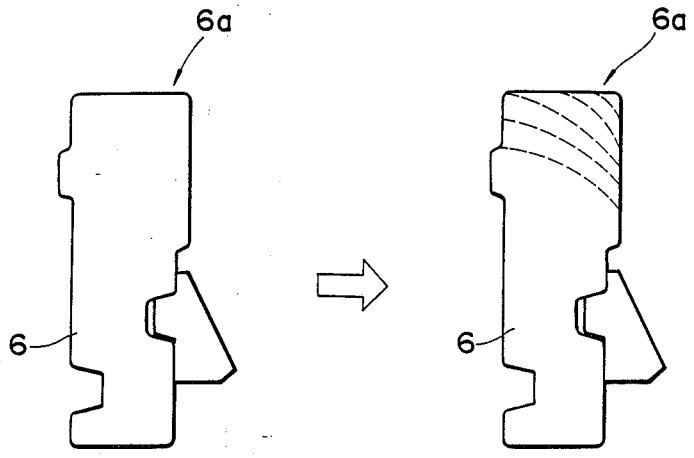
FIGURE 22(c)
PRIOR ART
FIGURE 22(d)
PRIOR ART
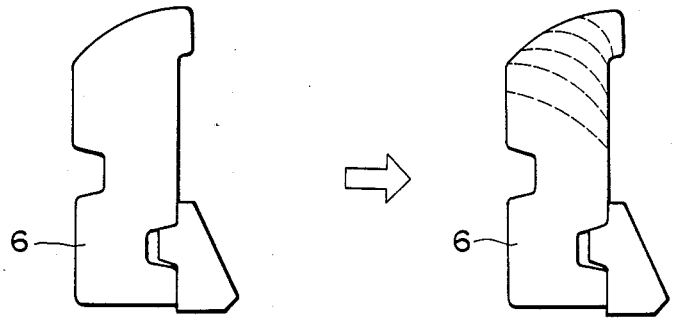

IMPACT CRUSHING MACHINE

BACKGROUND OF THE INVENTION

1. Field of the Invention:

The present invention relates generally to an impact crushing machine for crushing rocklike materials, such as rocks, ores and clinker, and, more particularly, to an impactor for such an impact crushing machine, having strikers resistant to wear and capable of being replaced by new ones when worn out.

2. Description of the Prior Art:

FIG. 21 illustrates a conventional impact crushing machine 1. A rocklike material fed through a feed opening 2 formed in one side of the upper part of the impact crushing machine 1 into a crushing chamber 3 is struck and crushed by strikers 6 fixedly attached to the periphery of a rotor 5 rotatively supported on a main shaft 4. Pieces of the rocklike material sent flying by the rotor 5 collide against and are crushed into smaller pieces by a liner *7a* attached to a first inpact plate liner 7 provided in the upper section of the crushing chamber 3. The pieces of the rocklike material repulsed by the first inpact plate liner 7 are struck further by the strikers 6. Then, some of the pieces of the rocklike material repulsed by the first inpact plate liner 7 and struck further by the strikers 6 are sent flying again against a liner *8a* of a second inpact plate liner 8 provided in the upper section of the crushing chamber, whereby the pieces of the rocklike material are crushed further into finer pieces.

The conventional impact crushing machine employs solid strikers 6 formed of a hard metal such as a high chromium cast iron, a high manganese steel or a chromium-molybdenum steel. However, since the rocklike material subjected to crushing includes hard mineral pieces, the strikers 6 are worn gradually as shown in FIGS. 22(*a*), 22(*b*), 22(*c*) and 22(*d*) by the frequent impact of the hard mineral pieces on the strikers 6. That is, the striking end *6a* of the striker 6 originally having an angular shape as indicated by solid lines in FIG. 22(*a*) is worn and rounded gradually as indicated by broken lines in FIG. 22(*b*).

Since it is economically disadvantageous to throw away the striker 6 worn in a shape as shown in FIG. 22(*b*), Japanese Patent Provisional Publication (Kokai) No. 58-174245 discloses an impact crushing machine in which the worn striker as shown in FIG. 22(*b*) is turned over for reuse in a position as shown in FIG. 22(*c*) and is used until the same is worn in shapes indicated by broken lines in FIG. 22(*d*) or a worn striker is inverted upside down for reuse.

Japanese Patent Provisional Publication (Kokai) No. 58-15079 discloses an impact crushing machine employing strikers each coated with an abrasion-resistant ceramic material to improve the abrasion resistance of the striker.

However, since the striker employed in the conventional impact crushing machine is not sufficiently abrasion-resistant, the striking end of the striker is worn round in a short period of use to strike rocklike pieces obliquely deteriorating the crushing ability of the impact crushing machine. Moreover, since the striker employed in the conventional impact crushing machine is a solid member, the worn striker must be replaced wholly by a new one, which requires an increased operating cost. Furthermore, the worn striker is replaced by a new one, or is turned over or inverted for reuse, for example, every one and half or three months when used for crushing rocks to produce aggregate. However, since the striker weighs about 100 kg, the replacement of the worn striker with a new one, or turning over or inverting the worn striker requires hard work.

The striker employed in the impact crushing machine disclosed in Japanese Patent Provisional Publication No. 58-15079 is provided with a abrasion-resistant chip, such as a hard ceramic chip or a hard metal chip. However, this striker has problems in that the striker must wholly be replaced with a new one when the abrasion-resistant chip is broken and that the hard metal chip is expensive and uneconomical. Accordingly, this striker is not applied practically to a heavy impact crushing machine.

SUMMARY OF THE INVENTION

Accordingly, it is an object of the present invention to provide an impact crushing machine provided with strikers which are durable, sufficiently abrasion-resistant and can easily be replaced with new ones when worn out.

In one aspect of the present invention, an impact crushing machine comprises a rotor mounted for rotation on a main shaft extended within a casing, a plurality of strikers for impinging rocklike pieces, fixedly attached to the circumference of the rotor to crush rocklike pieces and to send rocklike pieces flying, and a inpact plate liner for repulsing and crushing rocklike pieces, extended around the rotor at an appropriate distance from the circumference of the rotor. This impact crushing machine is characterized in that a plurality of seats are arranged in the axial direction of the rotor and are detachably fixed to the extremity of each striker, and striking chips formed of a hard material are fixed respectively to the seats.

In another aspect of the present invention, an impact crushing machine comprises a rotor mounted for rotation on a main shaft extended within a casing, a plurality of strikers for impinging rocklike pieces, fixedly attached to the circumference of the rotor to crush rocklike pieces and to send rocklike pieces flying, and an inpact plate liner for repulsing and crushing rocklike pieces, extended around the rotor at an appropriate distance from the circumference of the rotor. This impact crushing machine is characterized in that a plurality of seats are detachably fixed to the extremity of each striker, the plurality of striking chips formed of a hard material are fixed respectively to the seats, and the plurality of seats and/or the plurality of striking chips are arranged axially and radially of the rotor.

Since the striking end of the striker which is subjected to the highest impact is formed of a hard material, the sectional shape of the striker does not change significantly during crushing operation for an extended period of time and hence the opening 9 (FIG. 21) between the extremity of the striker and the inner end of a chute remains constant. Therefore, the dropping of rocklike pieces through the opening 9 is limited to the least extent, the crushing ability of the striker can always be maintained constant, the positional adjustment of the inpact plate liner, which has been necessary every seven to ten days, is not necessary, and abrasion of the liner of the impact crushing machine is reduced significantly because the rocklike pieces are crushed mainly by the strikers.

Since the plurality of striking chips formed of an expensive hard material are attached to the seat attached to the striking end of the striker respectively in the plurality of sections arranged radially and/or axially of the rotor, the worn striking chips can be changed individually or can be turned over or inverted individually for reuse, which enables the economical use of the expensive striking chips. In relacing the worn striking chip with a new one or in changing the position of the worn striking chips, each set of the striking chip and the seat can be removed individually from the rotor and hence the heavy striker need not be removed from the rotor, which facilitates replacing the worn striking chip with a new one and changing the position of the worn striking chip. Accordingly, the positional interchange between the striking chips disposed respectively at different specific positions and abraded partially with respect to the width due to their positional condition can readily be achieved.

BRIEF DESCRIPTION OF THE DRAWINGS

The above and other objects, features and advantages of the present invention will become apparent from the following description taken in conjunction with the accompanying drawings, in which:

FIGS. 22(*a*), 22(*b*), 22(*c*) and 22(*d*) are schematic side elevational views of assistance in explaining the mode of abrasion and the manner of reuse of a conventional striker.

DESCRIPTION OF THE PREFERRED EMBODIMENTS

Figure 1A:
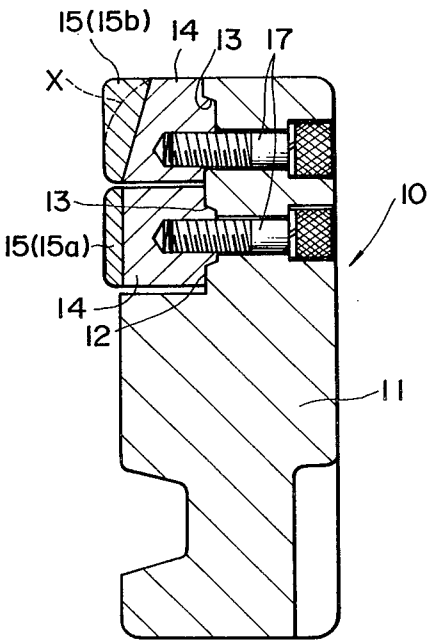
FIGS. 1(*a*) and 1(*b*) are a sectional side elevational view and a front elevational view (only the right half is shown), respectively, of a striker, in a first embodiment, according to the present invention.
Figure 1B:
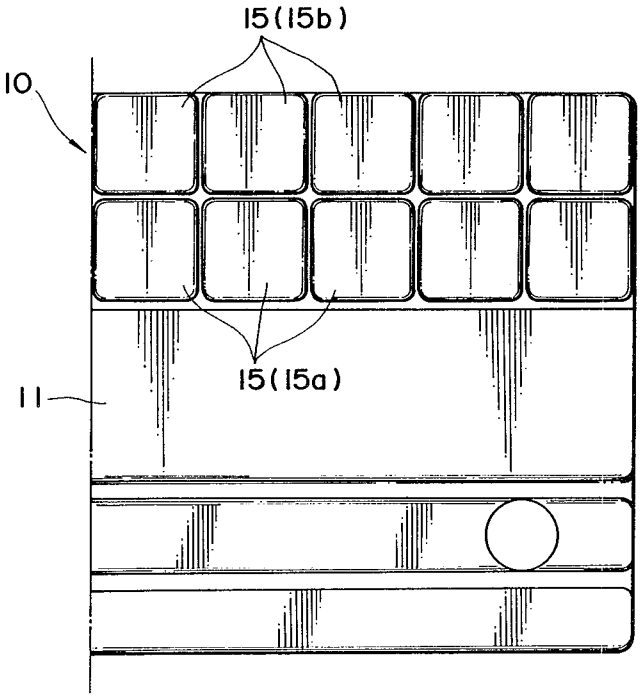
Figure 14:
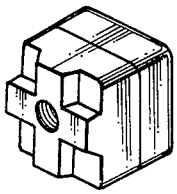
FIGS. 14(*a*), 14(*b*) and 14(*c*) are perspective views, respectively, showing the respective bottoms of seats.
Figure 14:
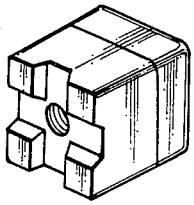
Figure 14:
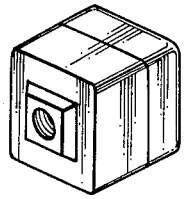

Referring to FIGS. 1(*a*) and 1(*b*), a striker 10, in a first embodiment, according to the present invention comprises a body 11 having a recessed part 12 having inlet parts 13, a plurality of seats 14, arranged in a row respectively fitting the recesses and fixed to the recessed part 12 of the body 11, and hard metal chips 15 respectively brazed to the seats 14. The seats 14 are detachably fixed to the body 11 respectively with bolts 17. A brazing sheet (i.e., a clad sheet formed by cladding both sides of a copper plate, respectively, with two layers of silver solder) is used for brazing the hard metal chip 15 to the seat 14. The hard metal chip 15 may be fixed to the seat 14 by welding, such as pressure welding by HIP, electron beam welding or laser welding, or by mechanical means. The inlet parts 13 are provided to prevent the seats 14 from being loosened by shocks and to prevent the action of a high centrifugal force on the bolts 17. The bottom surface of the seat 14 is engraved in a shape as shown in FIGS. 14(*a*), 14(*b*) or 14(*c*) so that the bottom surface and the inlet part 13 complement each other.

The seats 14 respectively holding the hard metal chips 15 are arranged axially and radially of a rotor 5. The hard metal chips 15 are classified into hard metal chips 15*a* having a smaller thickness and hard metal chips 15*b* having a larger thickness. The hard metal chips 15*a* are arranged along a radially inner line or row and the hard metal chips 15*b* are arranged along a radially outer line or row with respect to the rotor 5. The outer corner of each hard metal chip 15*b* tends to be abraded in a shape indicated by a broken line X. When one corner of the hard metal chip 15*b* is abraded to a maximum extent, the seat 14 holding the abraded hard metal chip 15*b* is inverted upside down to use the same hard metal chip 15b until the other corner thereof is abraded to an extent as indicated by a broken line Y.

To use both the opposite corners of the hard metal chip 15 by turning over or inverting the seat 14 holding the hard metal chip 15, it is desirable to form the hard metal chip 15 in a symmetrical shape with respect to the vertical or horizontal center line thereof, such as a square shape as shown in FIG. 1(*b*), or a circular shape. It is also desirable to chamfer the edges of the hard metal chip 15 in a radius of 4 mm to avoid the concentration of stress on the edges of the hard metal chip 15 in crushing rocks. Chamfering the edges of the hard metal chip 15 also is effective for relieving the residual strain of the corners of the contact surface.

The hard metal chip 15 may be formed of any suitable hard metal, for example, a WC (tungsten carbide) base hard metal containing appropriate amount of TiC (titanium carbide, TaC (tantalum carbide), NbC (niobium carbide), VC (vanadium carbide), $Mo_2C$ (molybdenum carbide) and/or TiN (titanium nitride). In most cases, Co (cobalt) is used as a bonding material. The (life ratio)/(cost ratio) of the hard metal chip formed of K20 (JIS B 4104) was greater than one.

It was found through experimental rock crushing operation that the life of the striker 10 employed in the first embodiment was six times that of a conventional striker formed of 27Cr cast steel or greater. Since the hard metal chip 15 is brittle, the hard metal chip 15 is not absolutely unbreakable. Therefore, the number of hard metal chips 15 which would be broken was estimated in relation to the amount of crushed rock through stochastic calculation using the respective Weibull distributions of the strength of rock and that of the hard metal chip, and hard metal chips which would be broken were eliminated beforehand through proof tests such as load tests. However, only a few hard metal chips were rejected. Thus, the accidental breakage of the hard metal chips during the rock crushing operation was avoided.

It was also found through the experimental rock crushing operation that crushed rocks produced in the initial stage of the rock crushing operation and crushed rocks produced in the final stage of the rock crushing operation in which abraded hard metal chips were used were the same in particle size distribution, which proved that the crushing ability of the striker of the present invention was not deteriorated through the rock crushing operation.

Figure 2A:
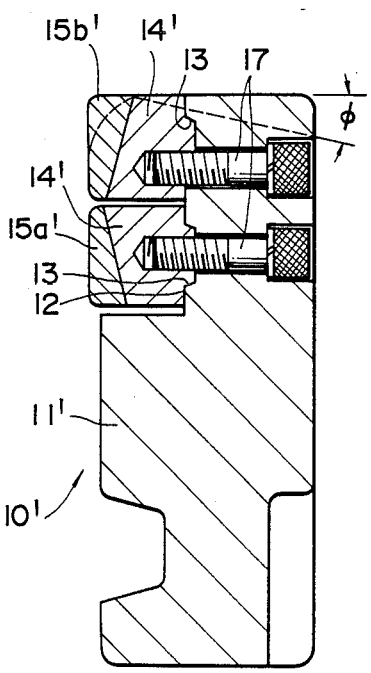
FIGS. 2(*a*) and 2(*b*) are sectional side elevational views respectively, of modifications of the striker of FIGS. 1(*a*) and 1(*b*)
Figure 2B:
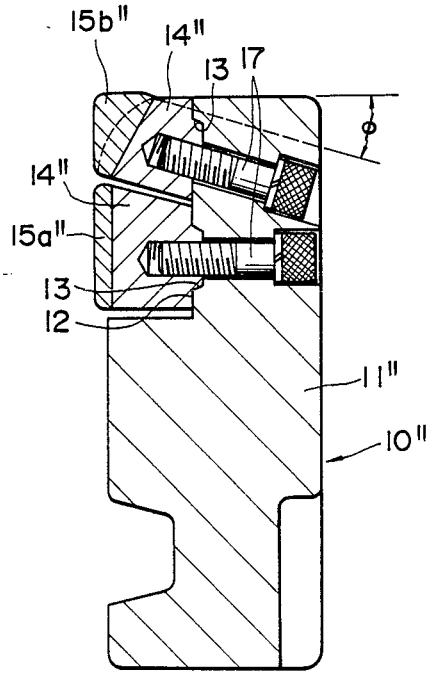

FIGS. 2(*a*) and 2(*b*) show modifications of the hard metal chip 15. In the modification shown in FIG. 2(*a*), the thickness of the hard metal chip 15b' is varied along the radial direction to reduce the quantity of the hard metal forming the hard metal chip, to extend the life of the striker and to use only one side of the hard metal chip so that the hard metal chip is economized. In such a tapered hard metal chip tapered toward the radially inner end thereof, the minimum thickness t is on the order of 3 mm and the inclination $\theta$ of the back surface to the front surface is in the range of 3° to 25°. Tensile stress exerted by the impact of a rocklike piece on the surface of the hard metal chip having a thickness of t can be analyzed by a finite element method and is expressed by $$\sigma = k(P/t^2)$$

where $\sigma$ is the tensile stress, k is a proportinal constant, and P is an impact applied to the hard metal chip by a rocklike piece. Therefore, the reduction of the minimum thickness t (FIG. 15) of the hard metal chip entails frequent cracking of hard metal chips. From such a point of view, various trial hard metal chips varying in the minimum thickness t in the range of 2 to 10 mm and in the inclination $\theta$ of the back surface in the range of 0° to 30° were subjected to cracking tests in which the circumferential speed of the rotor was 28 m/sec, the size of the rocklike pieces was in the range of 0 to 50 mm and crushing rate was 140 t/hr.

Figure 15:
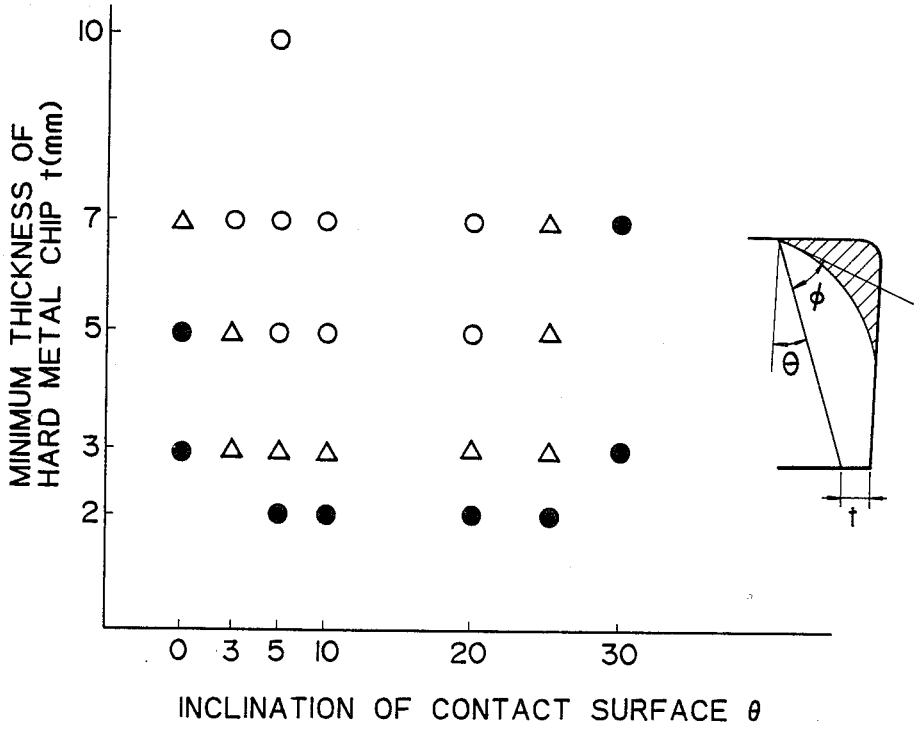
FIG. 15 is a graph showing the results of experimental use of various hard chips.

The results of the cracking test are shown in FIG. 15, in which black circles indicate hard metal chips which were cracked to an unusable degree, blank triangles indicate those which were partly chipped at the edges to a degree which will not interfere with the practical crushing operation of the impact crushing machine, and blank circles indicate those which were neither cracked nor chipped. As is obvious from FIG. 15, the hard metal chips are sufficiently durable when the inclination $\theta$ is in the range of 3° to 25° and the minimum thickness t is on the order of 3 mm. More explicitly, all the hard metal chips having the minimum thickness of 3 mm and the inclination $\theta$ in the range of 3 ° to 25° were cracked somewhat on the working surfaces thereof. This is due to the reduction of the minimum thickness t to the lower limit of the desirable range. All the hard metal chips having the inclination $\theta$ of 25° and the minimum thickness in the range of 3 to 7 mm were chipped somewhat. In those hard metal chips, the angle $\phi$ between a tangent f and the joining surface is an acute angle and thereby stress is concentrated on the contact point between the upper contact surface 23 of the hard metal chip and the body of the striker to chip a portion of the hard metal chip in the vicinity of the contact point.

A large inclination $\theta$ is advantageous in preventing cracking and chipping when the minimum thickness t is sufficiently large, because the greater the inclination $\theta$, the greater the thickness of the outer end of the hard metal chip. When the inclination $\theta$ was 3°, the hard metal chips respectively having a minimum thicknesses of 3 mm and 5 mm were chipped, while those having a minimum thickness of 7 mm or greater were not chipped. When the inclination $\theta$ was 5°, the hard metal chips having a minimum thickness t of 3 mm were chipped, while those having a minimum thickness t of 5 mm or above were not chipped.

Thus, it was found that hard metal chips having a minimum thickness t of 5 mm or above and the inclination $\theta$ in the range of 5° to 20° will not be chipped at all. The material forming the trial hard metal chips was K20 (JIS B 4104).

In the striker 10' shown in FIG. 2(*a*), the radially inner hard metal chip 15a' is inverted for successive use even if the worn radially outer hard metal chip 15b' is replaced with a new one. In the striker 10" shown in FIG. 2(*b*), the radially outer hard metal chip 15b" has a large inclination $\theta$ so that the thickness of the outer end which is subjected to the highest abrasive force is increased. However, the acute angle between the abraded surface and the joining surface of this chip is liable to be decreased rapidly, as compared with those of the hard metal chips of FIG. 1(*a*), 1(*b*) and 2(*a*), with the progress of abrasion of the hard metal chip, which is possible to entail the chipping of that portion. Therefore, in the striker 10" of FIG. 2(*b*), the outer end of the hard metal chip 15b" is protruded from the outer end of the seat 14" to prevent the rapid decrease of the acute angle. Chamfering the outer edge of the seat contiguous with the hard metal chip in a suitable radius also is effective for preventing cracking.

Figure 16:
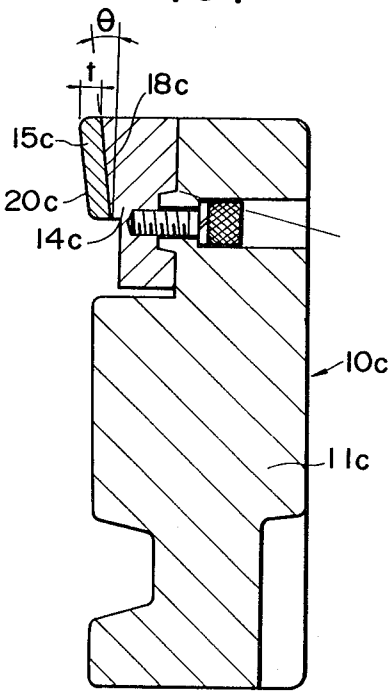
FIGS. 16(*a*), 16(*b*) and 16(*c*) are sectional views, respectively, of strikers embodying the present invention.
Figure 16:
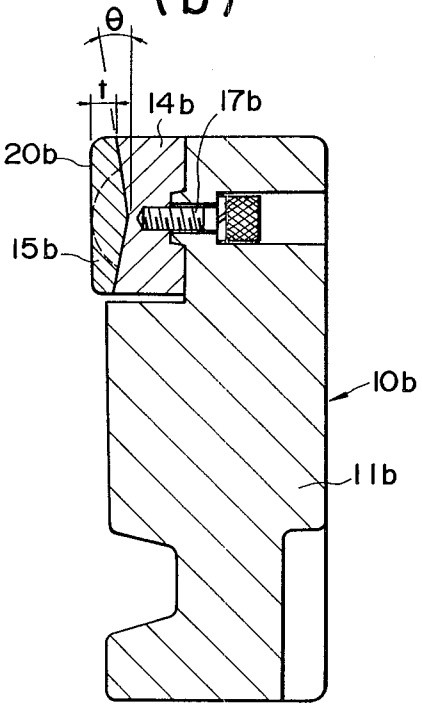
Figure 16:
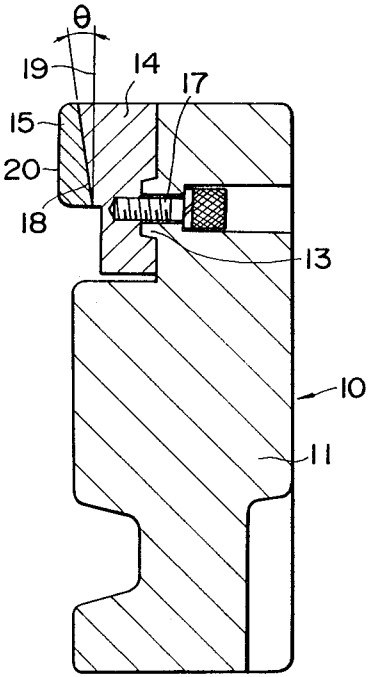

In embodiments of the present invention shown in FIGS. 16(*a*), 16(*b*) and 16(*c*), the contact surface of a seat 14 also is inclined at an inclination $\theta$. In this arrangement, the angle of the upper edge of a hard metal chip on the side of the seat remains in an obtuse angle even if the hard metal chip is abraded progressively, and hence the edge of the hard metal chip will not be chipped and the life of the hard metal chip will be extended.

Figure 17:
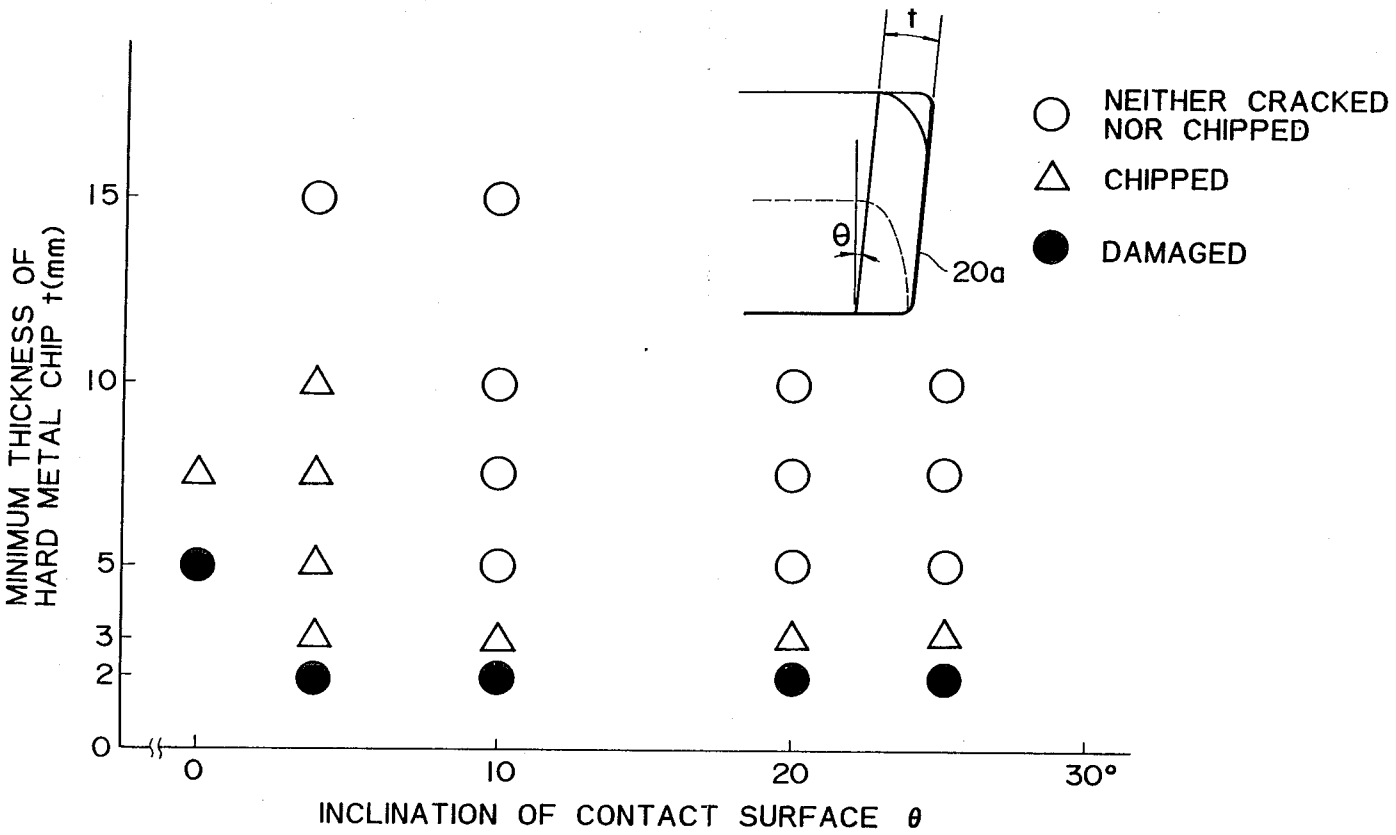
FIG. 17 is a graph showing the results of experimental use of various chips.

FIG. 17 shows the results of experimental rock crushing operation for the rock crushing tests of various hard metal chips 15*c* varying in a minimum thickness t using strikers as shown in FIG. 16(*c*) varying in the inclination $\theta$ of the contact surface 18*c* of the seat. In this experimental rock crushing operation, the circumferential speed of the rotor was 28 m/sec, the size of the rocks was in the range of 0 to 50 mm, the crushing rate was 140 t/hr, and the material of the hard metal chips 15*c* was K20 (JIS B 40104).

In FIG 17, blank circles indicate hard metal chips which were neither cracked nor chipped, blank triangles indicate those chipped somewhat to a degree which will not interfere with the crushing operation of the impact crushing machine, and black circles indicate those damaged seriously to an unusable degree.

As is obvious from FIG. 17, an inclination greater than an angle of 3° limited damages in the hard metal chips to an acceptable extent, and a minimum thickness t of 5 mm or above is sufficient when the inclination is an angle of 3° or above. However, when the minimum thickness is 3 mm, all the hard metal chips were chipped somewhat even if the inclination $\theta$ was greater than an angle of 3°, and all the hard metal chips were damaged to an unusable extent when the minimum thickness was 2 mm. Although the hard metal chips were neither cracked not chipped when the inclination $\theta$ was greater than an angle of 25°, rocks sent flying by the crushing surface 20*c* impinged against the backside of the body of the adjacent striker abrading the backside of the body when the inclination $\theta$ was greater than the angle of 25°. Therefore, it is not desirable to form the contact surface of the seat with an inclination greater than an angle of 25°.

Referring again to FIGS. 2(*a*) and 2(*b*), the respective upper ends of the bodies 11' and 11'' of the strikers 10' and 10'' are abraded in a shape as indicated by broken lines while the bodies 11' and 11'' are used for an extended period of operation, and thereby the bolts 17 respectively fastening the seats 14' and 14'' to the bodies 11' and 11'' are liable to be loosened. Therefore, it is desirable, if necessary, to position the bolt 17 fastening the seat 14' to the body 11' radially inside with respect to the center of the seat 14' as shown in FIG. 2(*a*) or to screw the bolt 17 fastening the seat 14'' to the body 11'' in the seat 14'' obliquely as shown in FIG. 2(*b*) depending on the kind of the rocklike material to be crushed.

When all the hard metal chips are the same in shape, all the seats are the same in shape and the seats holding the hard metal chips are arranged in two lines on the striker as mentioned above, the seats holding the hard metal chips and arranged on the radially outer line and those arranged on the radially inner line can be replaced with each other, when the hard metal chips on the radially outer line have been abraded to an unusable degree, to extend the life of the striker. Thus, the hard metal chips arranged on the radially inner line serve as spare parts.

Such an arrangement is possible in the striker 10 of FIG. 1(*a*) when the hard chips 15*a* and 15*b* are of the same thickness and the seats 14 are of the same thickness. Such an arrangement is possible also in strikers shown in FIGS. 3(*a*), 3(*b*), 4(*a*), 4(*b*), 4(*c*), 5(*a*) and 5(*b*), in which a single seat is divided into a plurality of sections arranged symmetrically in two or three lines and hard metal chips having the same shape or symmetrical shapes are brazed respectively to the plurality of sections of the seat.

Figure 3B:
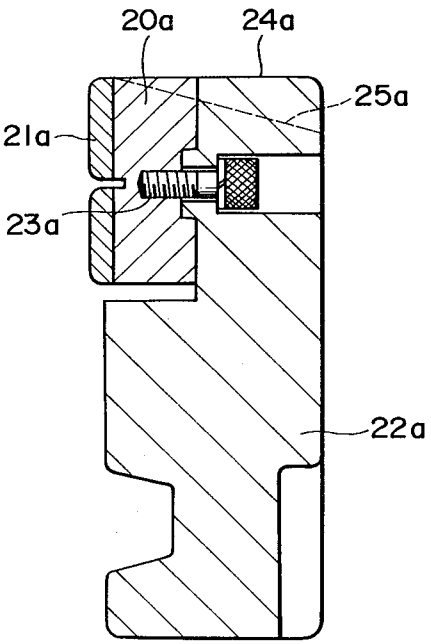
FIGS. 3(*a*) and 3(*b*) are a front elevational view (only the right half is shown) and a sectional side elevational view respectively, of a striker, in a second embodiment, according to the present invention.
Figure 3A:
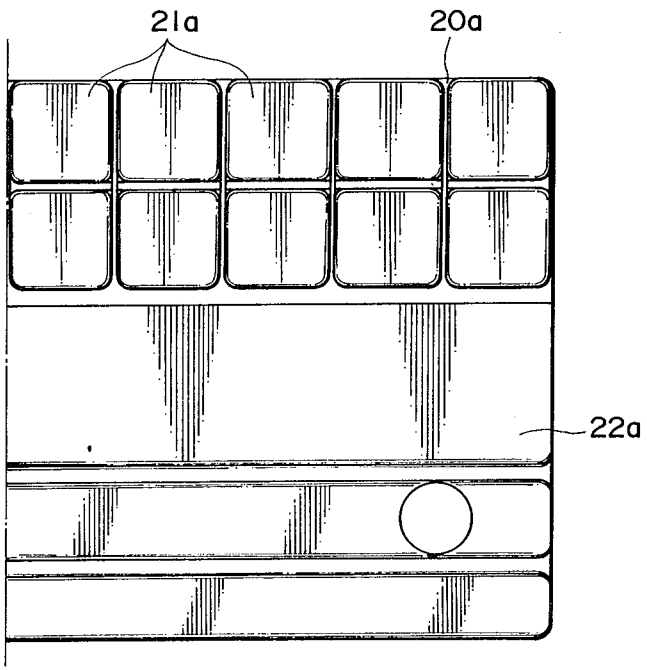

In the striker in a second embodiment according to the present invention shown in FIGS. 3(*a*) and 3(*b*), a plurality of hard metal chips 21*a* having the same shape are brazed to a rectangular seat 20*a* in two lines, namely, a radially outer line and a radially inner line. Bolts 23*a* fastening the seat 20*a* to the body 22*a* of the striker are removed, and then the seat 20*a* is inverted upside down to extend the life of the striker. In this striker, the bolts 23*a* are screwed in the seat 20*a* in the middle portion of the same with respect to the radial width as best shown in FIG. 3(*b* ). Therefore, the distance between the top 24*a* of the body 22*a* and the center axis of each bolt 23*a* is sufficiently long. Accordingly, even if the top 24*a* of the body 22*a* is abraded greatly as indicated by a broken line 25*a*, the bolts 23*a* are not exposed to the impact of rocklike pieces and hence the bolts 23*a* are not caused to be loosened.

Figure 4C:
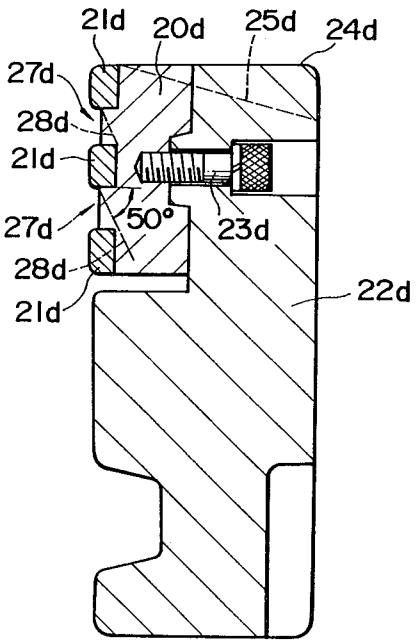
FIGS. 4(*a*), 4(*b*) and 4(*c*) are sectional side elevations, respectively, of modifications of the striker of FIGS. 3(*a*) and 3(*b*)
Figure 4B:
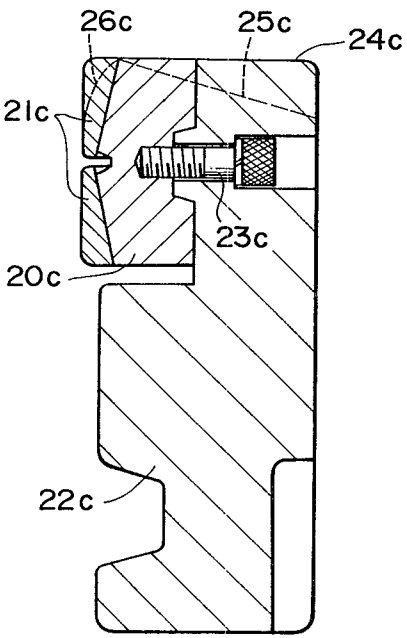
Figure 4A:
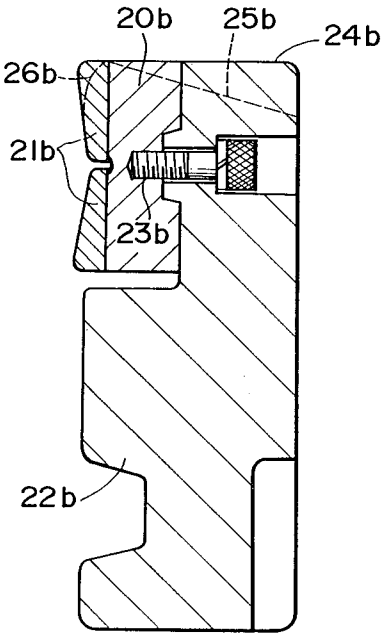

In the striker shown in FIG. 4(*a*) (FIG. 4(*b*)), hard metal chips 21*b* (21*c*) are arranged symmetrically in two lines with the thinner end of each hard metal chip 21*b* (21*c*) positioned on the side of the line of symmetry so that the hard metal chips 21*b* (21*c*) are abraded evenly as indicated by a broken line.

In the striker shown in FIG. 4(*c*), hard metal chips 21*d* are arranged in three lines, and dead stocks 28*d* indicated by broken lines are formed in the gaps 27*d* between the radially adjacent hard metal chips 21*d* to suppress the abrasion of a seat 20*d*.

In the strikers shown in FIGS. 4(*a*), 4(*b*) and 4(*c*), the distance between the top of the body of each striker and the center axis of each bolt 23*b*, 23*c* or 23*d*, similarly to the in the striker shown in FIG. 3(*b*), is sufficiently large, and hence the heads of the bolts 23*b*, 23*c* and 23*d* are not exposed to the abrasive action of rocklike pieces.

Figure 5B:
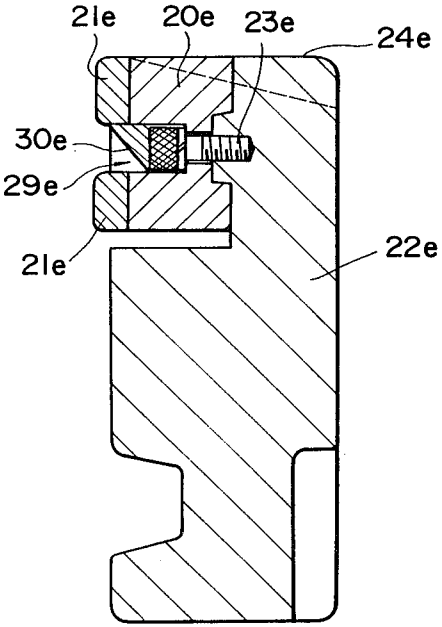
FIGS. 5(*a*) and 5(*b*) are a front elevational view (only the right half is shown) and a sectional side elevational view respectively, of a striker, in a third embodiment, according to the present invention.
Figure 5A:
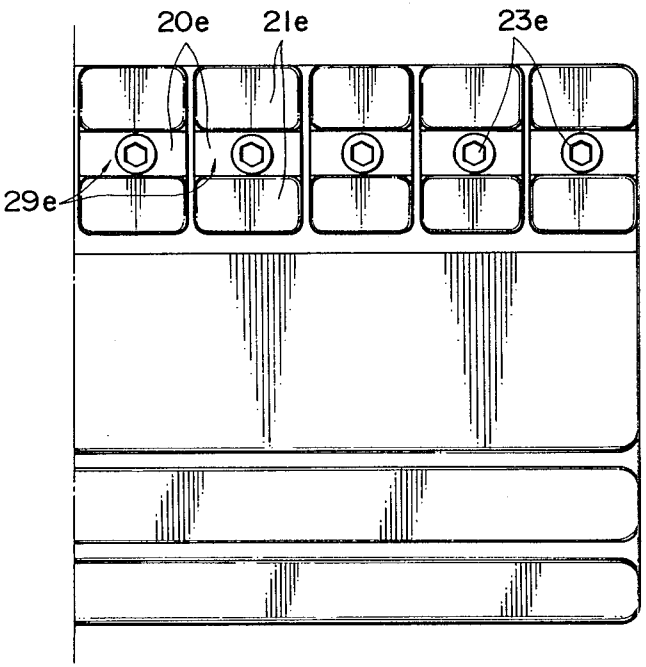

FIGS. 5(*a*) and 5(*b*) show a striker, in a third embodiment, according to the present invention. In this striker, each bolt 23*e* is inserted through a through hole formed in a seat 20*e* and is screwed in the body 22*e* of the striker. Counterbores 29*e* are formed in the impact surface of the seat 20*e* to receive the heads of the bolts 23*e*, respectively. During the crushing operation, dead stock 30*e* is formed in the counterbores 29*e* to prevent abrasion of the heads of the bolts 23*e*.

Figure 6C:
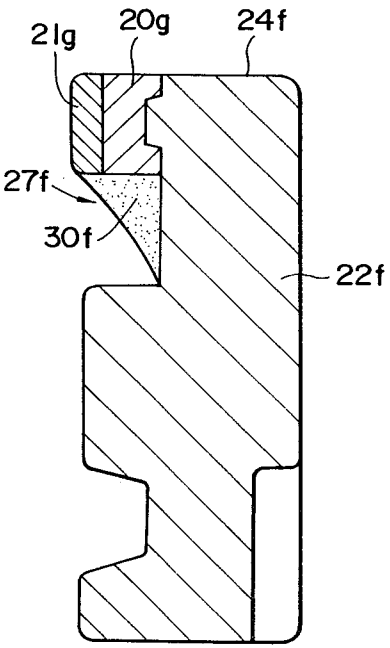
FIGS. 6(*a*), 6(*b*) and 6(*c*) are a front elevational view (only the right half is shown, a sectional view taken on line A—A in FIG. 6(*a*) and a sectional view taken on line B—B in FIG. 6(*a*), respectively, of a striker, in a fourth embodiment, according to the present invention.
Figure 6B:
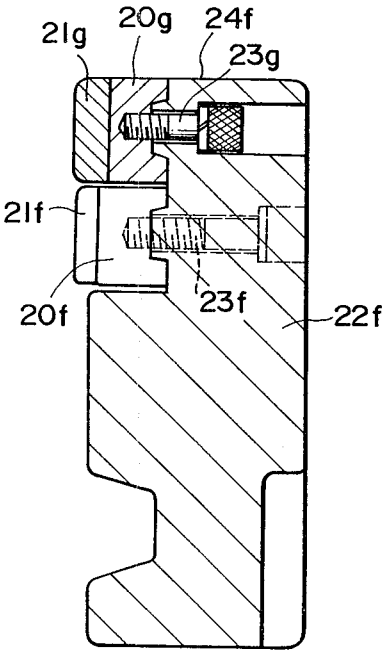
Figure 6A:
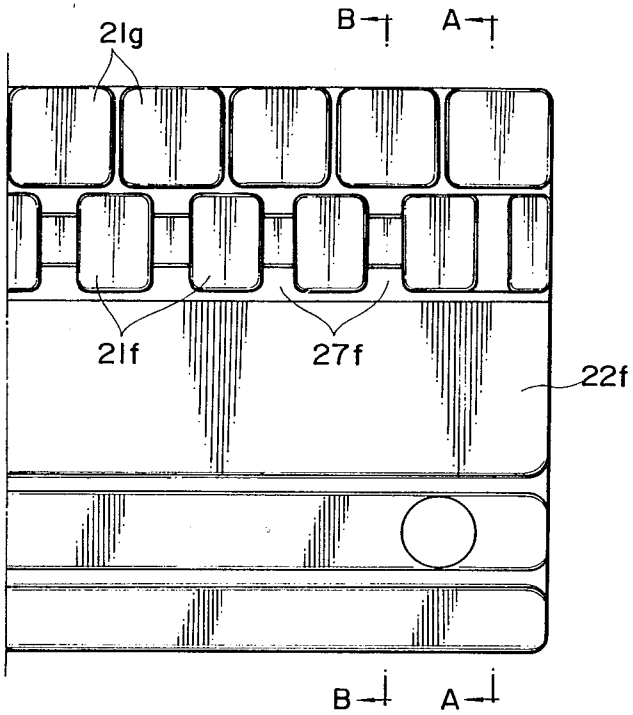
Figure 7A:
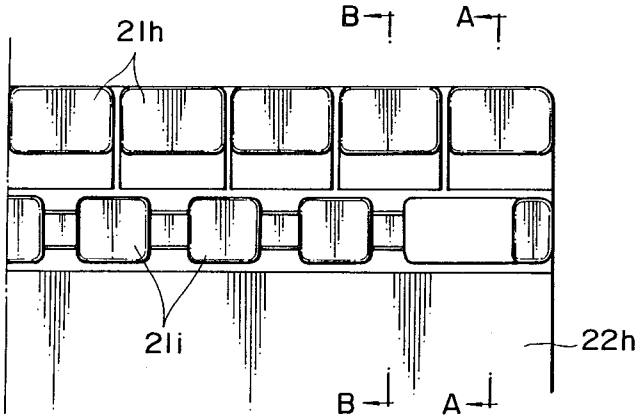
FIGS. 7(*a*), 7(*b*) and 7(*c*) are a fragmentary front elevational view (only the right half is shown), a fragmentary sectional view taken on line A—A in FIG. 7(*a*) and a fragmentary sectional view taken on line B—B in FIG. 7(*a*), respectively, of a striker, in a fifth embodiment, according to the present invention FIGS. 8(*a*) and 8(*b*) are a fragmentary front elevational view and a fragmentary sectional view, respectively, of a striker, in a sixth embodiment, according to the present invention.
Figure 7B:
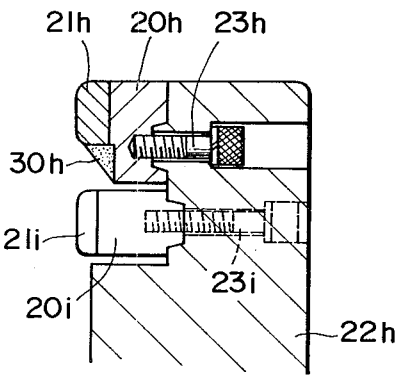
Figure 7C:
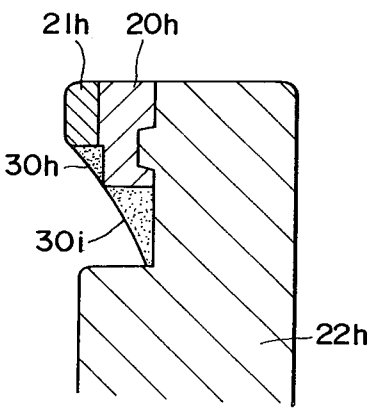

FIGS. 6(*a*), 6(*b*) and 6(*c*) show a striker in a fourth embodiment according to the present invention and FIGS. 7(*a*), 7(*b*) and 7(*c*) show a modification of the same striker. In this striker, hard metal chips 21*f* having a relatively small width with respect to the axial direction are arranged on a radially inner line and hard metal chips 21*g* having a relatively large width with respect to the axial direction are arranged on a radially outer line so that the hard metal chips 21*f* and 21*g* are arranged in a zigzag arrangement. Therefore, dead stocks 30*f* are formed respectively in gaps 27*f* between the adjacent hard metal chips 21*f* as shown in FIG. 6(*c*). Thus, the quantity of the expensive hard metal chips used in this embodiment is less than that of the hard metal chips used in the first embodiment shown in FIG. 1(*a*) by about 15% of the quantity of the hard metal chips used in the first embodiment. The life of the striker in the fourth embodiment provided with the hard metal chips 21*g* formed of a hard metal K20 (JIS B 4104) or a thickness of 15 mm was about ten times that of a conventional solid striker formed of a chromium-rich cast steel.

A striker in a fifth embodiment according to the present invention shown in FIGS. 7(*a*), 7(*b*) and 7(*c*) is a modification of the striker in the fourth embodiment. In this striker, hard metal chips 21*h* arranged on a radially outer line have a relatively small height, namely, a small vertical size as viewed in FIG. 7(*a*), as compared with that of the hard metal chips 21*g* of the fourth embodiment, and hard metal chips 21*i* arranged on a radially inner line have a relatively small height as compared with that of the hard metal chips 21*f* of the fourth embodiment. Therefore, a relatively large gap as compared with that of the fourth embodiment is formed between the hard metal chips 21*h* on the radially outer line and the hard metal chips 21*i* arranged on the radially inner line. As shown in FIG. 7(*c*), dead stocks 30*h* and 30*i* are formed over exposed parts not covered with the hard metal chips 21*h* and 21*i*, so that the abrasion of the exposed parts is prevented. In this embodiment, the quantity of the hard metal chips is further reduced as compared with that of the hard metal chips of the fourth embodiment. The life of the striker in the fifth embodiment was substantially the same as that of the striker in the fourth embodiment. The quantity of the hard metal used for forming the hard metal chips of the fifth embodiment was less than that of the hard metal used for forming the hard metal chips of the first embodiment (FIG. 1(*a*)) by about 30% of the latter.

In each of the foregoing embodiments, the radial size of the gap between the hard metal chips arranged on the radially outer line and those arranged on the radially inner line is smaller than the radial size of the hard metal chips.

Figure 8B:
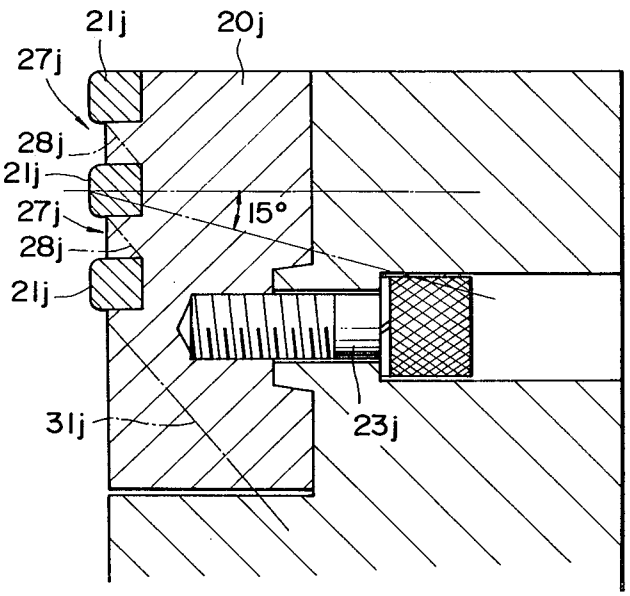
Figure 8A:
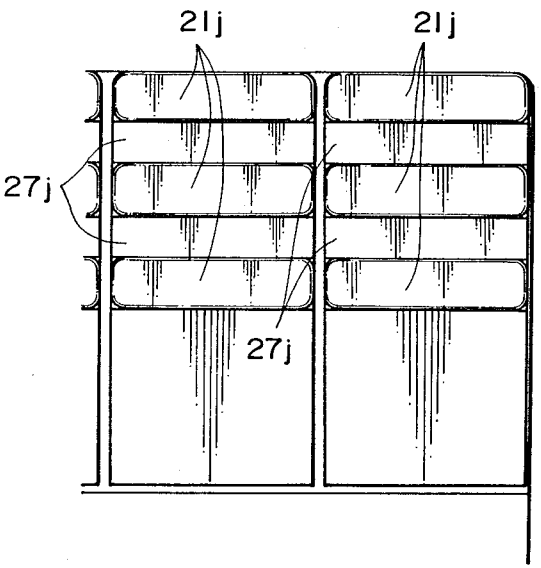

FIGS. 8(*a*) and 8(*b*) show a striker in a sixth embodiment according to the present invention. In this striker, laterally elongate hard metal chips 21*j* are brazed to the radially outermost portion of a seat 20*j* in three lines. Dead stocks 28*j* are formed as indicated by broken lines in gaps 27*j* between the radially adjacent hard metal chips 21*j*. The hard metal chips 21*j* arranged on the radially outer and middle lines are subjected to the abrasive action of rocklike pieces, while the hard metal chips 21*j* arranged on the radially inner line protect a portion of the seat 20*j* in which bolts 23*j* are screwed. Although the radially inner portion of the seat 20*j* is abraded finally to a surface indicated by an alternate long and short dash line in FIG. 8(*b*), threaded holes for receiving the bolts 23*j* are protected by the hard metal chips 21*j* arranged on the radially inner line.

Figure 9:
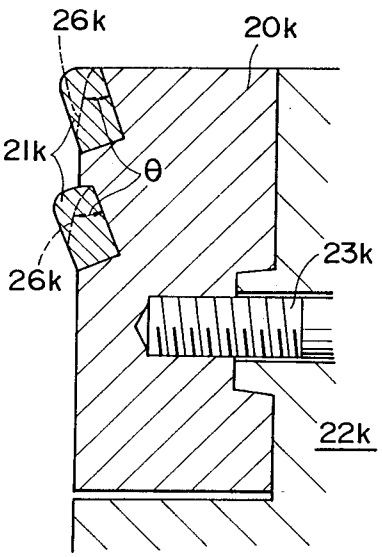
FIG. 9 is a fragmentary sectional view of a modification of the striker of FIGS. 8(*a*) and 8(*b*)

FIG. 9 shows a modification of the striker in the sixth embodiment. In this striker, hard metal chips 21*k* are arranged in two lines and are attached obliquely to a seat 20*k* relative to the surface of the seat 20*k*. Therefore, the angle $\theta$ of the upper corner of the abraded hard metal chip 21*k*, namely, the angle between the abraded surface 26*k* of the hard metal chip 21*k* and the back of the same seated on the recess in the seat 20*k*, is large when the hard metal chip 21*k* is abraded to the maximum degree, and hence the upper corner of the hard metal chip 21*k* is hardly chipped.

In the foregoing embodiments, the hard metal chips are arranged on the body of the striker in lines and rows. In practical crushing operation, only the hard metal chips arranged on the radially outer line among the hard metal chips are abraded intensely while the rest of the hard metal chips are scarcely abraded. Accordingly, the hard metal chips need not be arranged in a plurality of axial lines if only a crushing function matters; a plurality of hard metal chips may be attached to a plurality of seats arranged in a single axial line along the outer end of the body of the striker or to a single seat having a plurality of sections and extended in an axial direction along the outer end of the body of the striker as illustrated in FIGS. 10(*a*), 10(*b*), 11(*a*) to 11(*c*), 12(*a*), 12(*b*), 13(*a*) and 13(*b*).

Figure 10B:
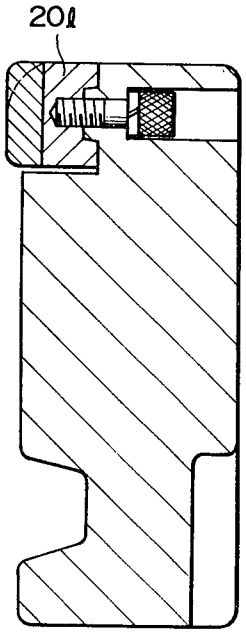
FIGS. 10(*a*) and 10(*b*) are a front elevational view (only the half is shown) and a sectional view, respectively, of a striker, in a seventh embodiment, according to the present invention.
Figure 10A:
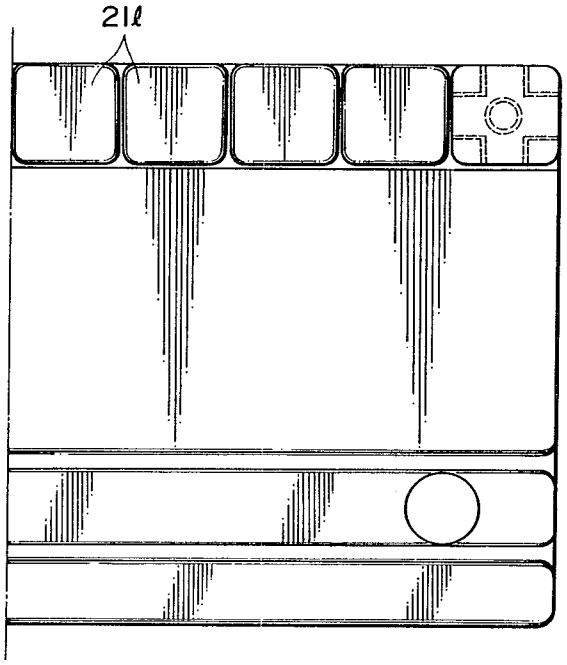
Figure 18:
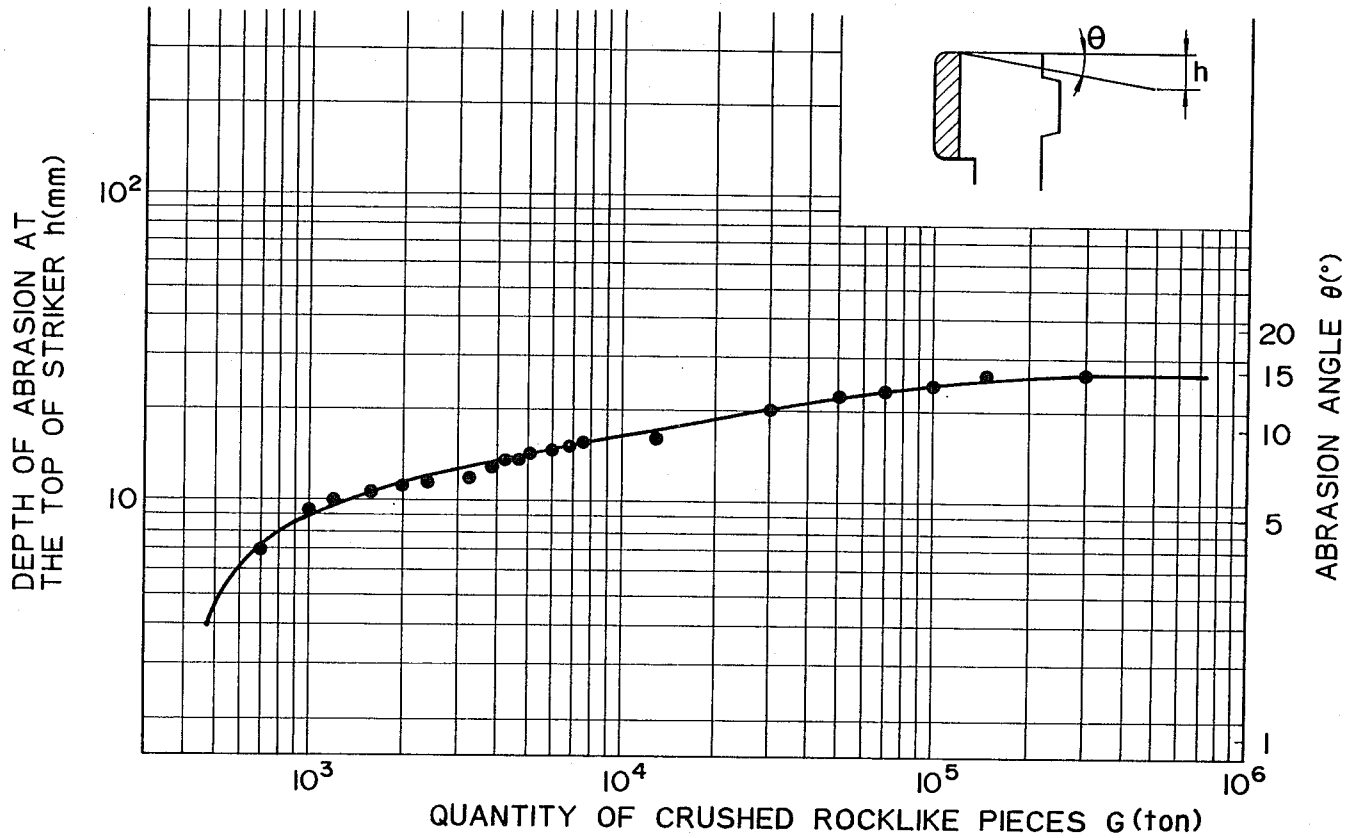
FIG. 18 is a graph showing the variation of depth of abrasion of a striking head of a striker with the amount of crushed rock.

In a striker in a seventh embodiment according to the present invention shown in FIG. 10, a plurality of hard metal chips 21*l* are arranged in a single axial line. Each hard metal chip 21*l* and each seat 20*l* are square in shape. Therefore, when one edge of the hard metal chip 21*l* is abraded to a maximum extent, the seat 20*l* can be turned through an angle of 90° to use a new edge of the hard metal chip 21*l*. The life of the striker in the seventh embodiment was 10 times that of the conventional striker formed of high chromium cast iron. As mentioned above, the seat and the body of the striker are abraded in shapes indicated by broken lines 25*b*, 25*c* and 25*d* in FIGS. 4(*a*), 4(*b*) and 4(*c*). It was found that the angles respectively between the abraded surface indicated by the broken line 25*b* and the top 24*b*, between the abraded surface indicated by the broken line 25*c* and the top 24*c*, and between the abraded surface indicated by the broken line 25*d* and the top 24*d* is approximately an angle of 15°. That is, these broken lines correspond to a falling curve of rocklike pieces. FIG. 18 shows the results of experimental examination of the falling mode of rocklike pieces.

Figure 19:
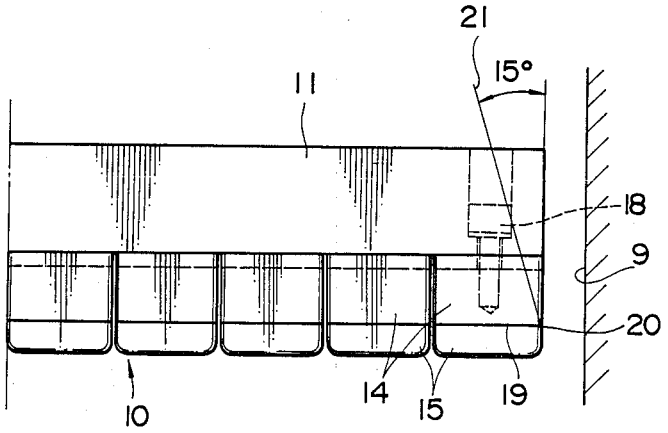
FIG. 19 is a fragmentary top view of a striker showing the disposition of a bolt for fastening a seat to the striking end of a striker.

FIG. 18 is a graph showing the variation of the depth of abrasion at the top of the striker with the quantity of crushed rocklike pieces, hence, the duration of crushing operation. As is obvious from FIG. 18, the depth of abrasion increases to a value on the order of 27 mm and the angle $\theta$ between the top and the abraded surface increases to an angle of 15° and the depth of abrasion and the angle $\theta$ remain constant thereafter. Therefore, when the fastening members such as bolts are provided on radially inner side relative to the broken line indicating the limit of abrasion, the fastening member will not be abraded. Furthermore, a bolt fastening the axially outermost seat 14 to the body of the striker is positioned axially inside relative to a plane inclined at an angle of 15° to the surface of a side casing liner 9 and passing the axially outer end 20 of the contact surface 19 between the hard metal chip 15 and the seat 14 as shown in FIG. 19.

Figure 20:
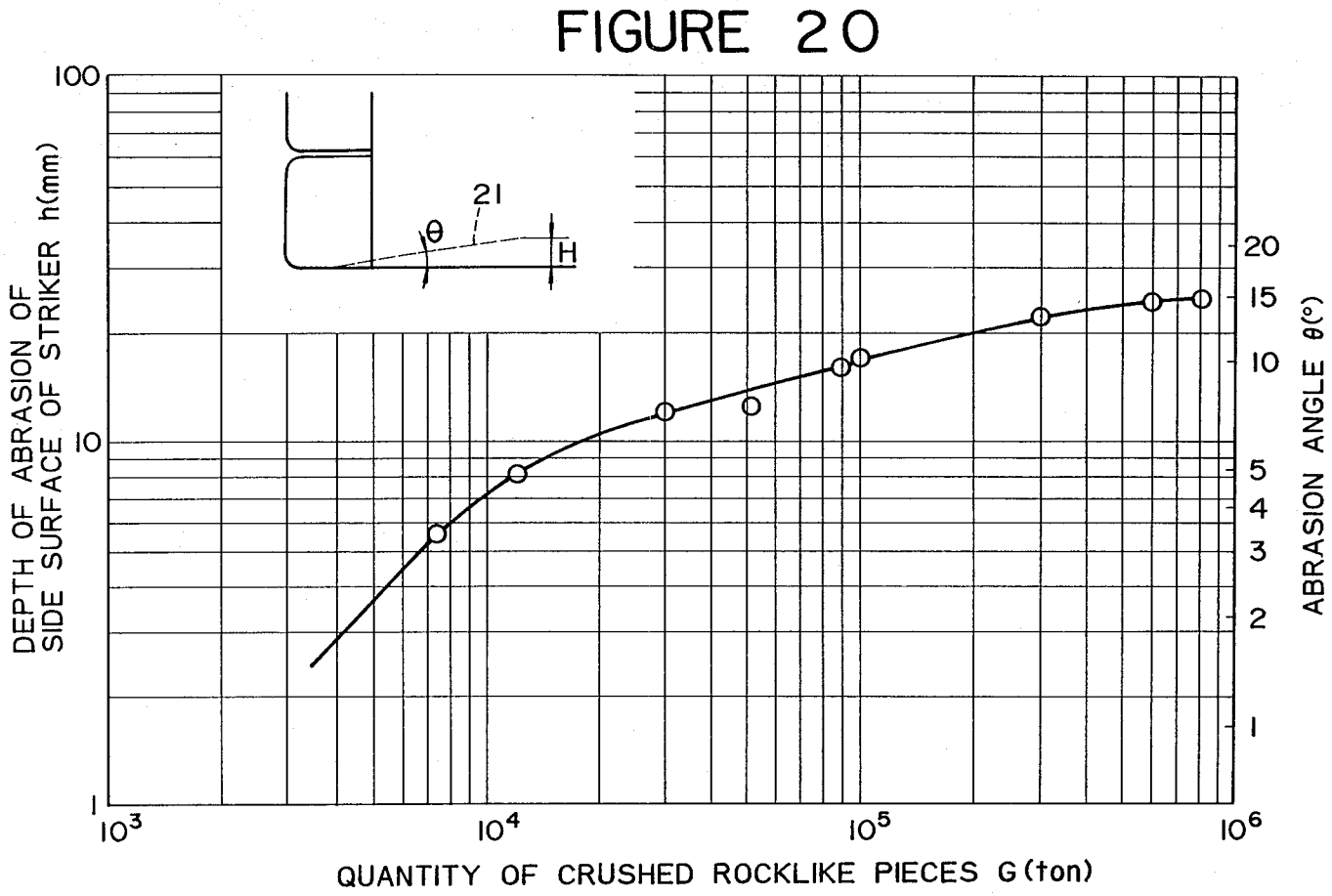
FIG. 20 is a graph showing the variation of depth of abrasion of the back side of a striker with the amount of crushed rock.
Figure 21:
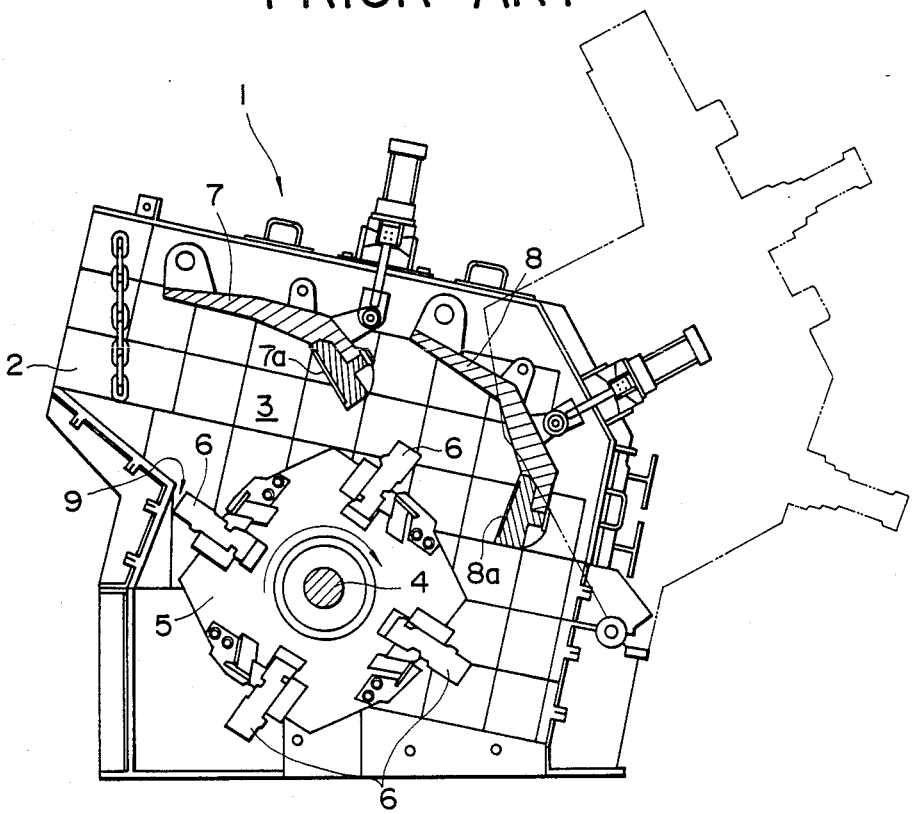
FIGURE 21 PRIOR ART
FIG. 21 is a sectional side elevational view of a conventional impact crushing machine.

FIG. 20 is a graph showing the variation of the measured depth h of abrasion of the side surface of the striker and that of the measured angle $\theta$ between the abraded surface 21 and the side surface of the striker with the quantity of crushed rocklike pieces, hence, with the duration of crushing operation when the rotor 5 was rotated at a circumferential speed of 28 m/sec for experimental crushing operation. As is obvious from FIG. 20, the depth h increased to a value on the order of 25 mm and the angle $\theta$ increased to an angle of 15° and remained constant thereafter regardless of the material of the body of the striker. Accordingly, the bolt will not be abraded when the same is provided at a position axially inside the abraded surface 21 inclined at an angle of 15° to the original side surface of the striker.

Figure 11A:
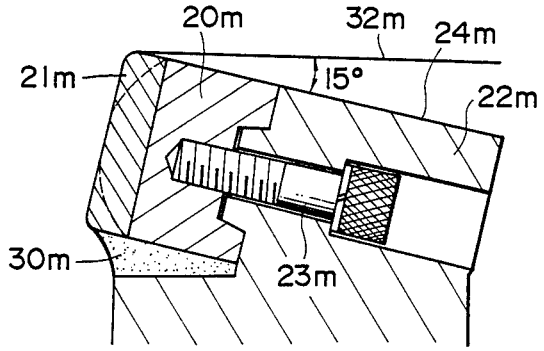
FIGS. 11(*a*), 11(*b*) and 11(*c*) are fragmentary sectional views, respectively, of modifications of the striker of FIGS. 10(*a*) and 10(*b*)
Figure 11B:
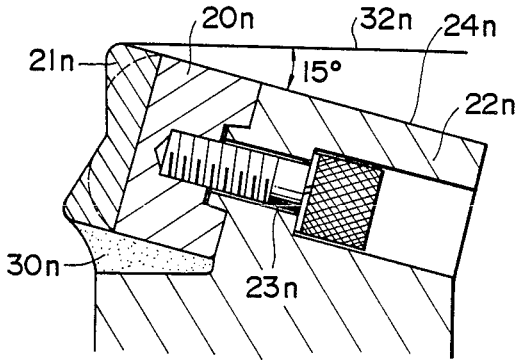
Figure 11C:
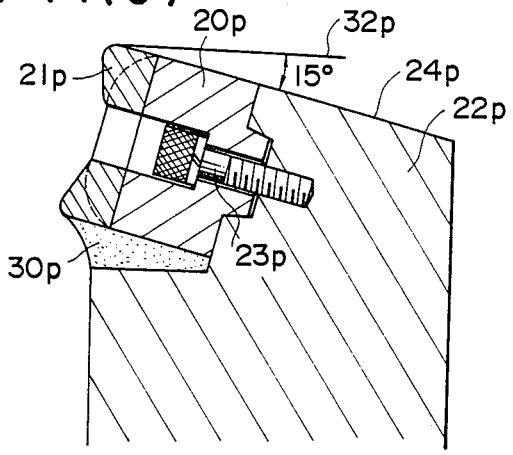

The strikers shown in FIGS. 11(*a*), 11(*b*) and 11(*c*) are designed on the basis of such experimental results. A top surface 24*m* (24*n*, 24*p*) including those of a seat 20*m* (20*n*, 20*p*) and the body 22*m* (22*n*, 22*p*) of the striker (strikers) is inclined radially inward at an angle of 15° to a tangent 32*m* (32*n*, 32*p*) to a hard metal chip 21*m* (21*n*, 21*p*) at the upper end of the same. Accordingly, the seat 20*m* (20*n*, 20*p*) and the body 22*m* (22*n*, 22*p*) are not subject to abrasion, and hence the head of a bolt 23*m* (23*n*, 23*p*) fastening the seat 20*m* (20*n*, 20*p*) to the body 22*m* (22*n*, 22*p*) is not abraded. Furthermore, since a portion of the seat 20*m* (20*n*, 20*p*) near the contact surface between the hard metal chip (21*m* (21*n*, 21*p*) and the seat 20*m* (20*n*, 20*p*) is not abraded in a groove, the hard metal chip is hardly chipped even if the upper edge of the hard metal chip is abraded with a sharp edge, which further reduces the consumption of the hard metal chips.

Figure 12:
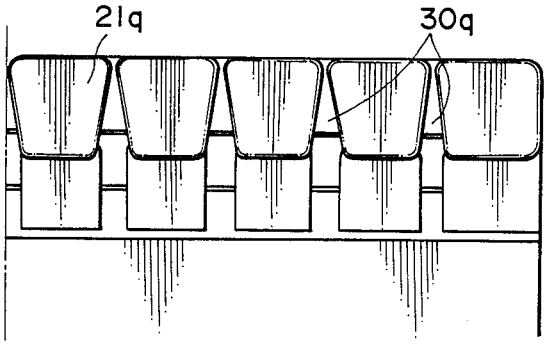
FIGS. 12(*a*) and 12(*b*) are a fragmentary front elevational view (only the half is shown) and a fragmentary sectional view, respectively, of a striker, in a eighth embodiment, according to the present invention.
Figure 12:
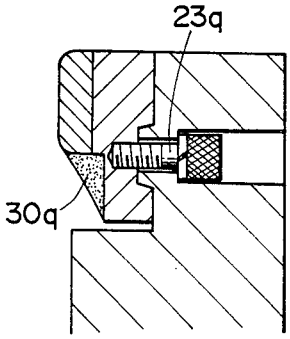

FIGS. 12(*a*) and 12(*b*) show a striker in a eighth embodiment according to the present invention. In this embodiment, hard metal chips 21*q* each have the shape of a isosceles trapezoid in a front elevational view and disposed with the longer one of the parallel sides flush with the top of the body of the striker. Dead stocks 30*q* are formed in substantially triangular gaps between the adjacent hard metal chips 21*q*. The quantity of the hard metal chips 21*q* used in this embodiment is smaller than that of the hard metal chips 21*l* used in the seventh embodiment shown in FIGS. 10(*a*) and 10(*b*), and is smaller than that of the hard metal chips 15 used in the first embodiment shown in FIG. 1(*a*) by more than 50% of the quantity of the hard metal chips 15. Thus, the eight embodiment is very economical. Since the exposed surface of a seat holding the hard metal chips 21*q* and fastened to the body of the striker with bolts 23*q* is protected by the head stocks 30*q*, the seat is not subject to abrasion.

Figure 13:
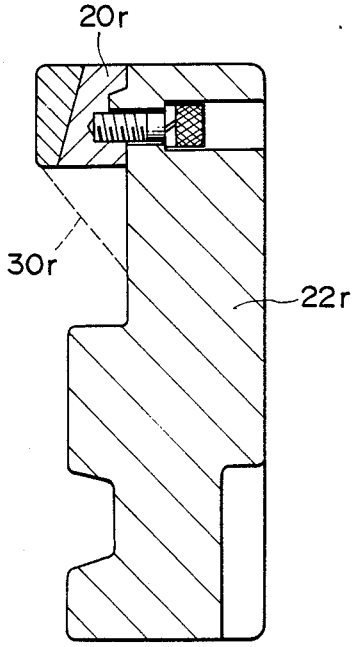
FIGS. 13(*a*) and 13(*b*) are sectional views, respectively, of modifications of the striker of FIGS. 12(*a*) and 12(*b*)
Figure 13:
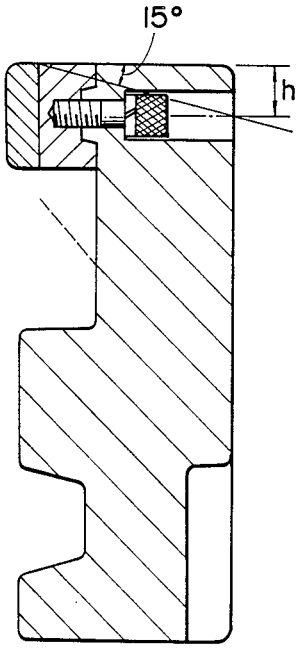

Thus, in the strikers shown in FIGS. 4(*c*), 5(*b*), 6(*c*), 7(*c*), 8(*b*), 11(*a*) to 11(*c*), and 12(*b*), dead stocks are formed over corners between the radially inner surfaces of the hard metal chips and the seats, and the front surfaces of the body and the seats to protect the corners from abrasion. In a striker shown in FIG. 13(*a*), as compared with the striker shown in FIG. 10(*b*), the front surface of the upper end of a body 22*r* is recessed in a wider area so as to extend in flush with the contact surface between a seat 20*r* and the body 22*r* and to extend radially inward from the radially inner side of the seat 20*r*, and dead stock 30*r* is formed over the exposed portion of the front surface of the recessed part to suppress the abrasion of the body 22*r* to the least extent.

In the foregoing embodiments, each hard metal chip is joined to each seat by fusion such as brazing, and the seat is detachably fixed to the body of the striker. Accordingly, the worn or chipped hard metal chips can individually be changed for new ones by removing the seats from the body of the striker without requiring heavy work such as for replacing a conventional worn striker by a new one.

The foregoing embodiments are the application of the present invention to an impact crushing machine provided with strikers which are fixedly mounted on a rotor. Naturally, the present invention is applicable also to an impact crushing machine provided with strikers capable of swinging back and forth with respect to the rotating direction of the rotor. Furthermore, the hard metal chips may be provided on the front surface of both the opposite ends of the body of a striker or on the front and back surfaces of one end of the body of a striker in order to use the striker in an inverted position.

As is apparent from the foregoing description, an impact crushing machine according to the present invention comprises a rotor mounted for rotation on a main shaft extended within a casing, a plurality of strikers for striking rocklike pieces fixedly attached to the circumference of the rotor, and a repulsing plate extended around the rotor at an appropriate distance from the rotor, crushes rocklike pieces by applying an impact to rocklike pieces with the extremities of the strikers and the repulsing plate, and is characterized in that a plurality of seats are removably attached to the extremity of the body of each striker and that a hard metal chip is joined to each seat by fusion such as brazing. Therefore, only the hard metal chips which are far more abrasion-resistant than the conventional strikers formed of a high chromium cast iron are exposed to the impact of rocklike pieces, and hence the strikers of the present invention can be used for an extended period of operation and thereby the period of maintenance is extended remarkably. Since the hard metal chips and the seats are arranged individually in lines and rows or in a line, each seat can individually be removed from the body of the striker to change a worn hard metal chip for a new one, or the seat can be turned over or inverted to use an unworn portion of the hard metal chip held thereon when the previously working portion of the same hard metal chip is worn to a maximum extent, so that the expensive hard metal chips are economized. Furthermore, in replacing a worn hard metal chip with a new one, only a member having a weight of two to three kilograms including the weight of the seat needs to be removed from the striker instead of wholly removing, for example, the conventional striker having a weight greater than 100 kg from the rotor. Thus, the worn hard metal chip can be replaced with a new one through a simple technique without requiring a heavy work.

Obviously, numerous modifications and variations of the present invention are possible in light of the above teachings. It is therefore to be understood that within the scope of the appended claims, the invention may be practiced otherwise than as specifically described herein.

What is claimed is:

1. An impact crushing machine, comprising:

a casing;

a rotor supported for rotation on a main shaft extended within said casing;

a plurality of strikers fixed to the circumference of the rotor;

an impact plate liner extending around the rotor at a predetermined distance from the rotor;

a plurality of seats arranged axially in at least one row and radially of the rotor and which are removably fixed to each striker;

a plurality of hard metal chips fixed, respectively, to said seats wherein said hard metal chips are removably attached to said seats, and at least a contact surface between the seat provided on the radially outer line and each hard metal chip joined to said seat is inclined toward the direction of rotation of said rotor at an angle of 3° to 25°.

2. An impact crushing machine according to claim 1, wherein a thickness dimension of said hard metal chips at a radially inner part is greater than that at a radially outer part.

3. An impact crushing machine, comprising:

a casing;

a rotor supported for rotation on a main shaft extending within said casing;

a plurality of strikers fixed to the circumference of said rotor;

an impact plate liner extending around said rotor at a predetermined distance from the rotor;

a plurality of seats arranged axially in at least one row and radially of the rotor and which are removably fixed to each striker;

a plurality of hard metal chips fixed to said seats wherein said seats are fastened to each striker so that an entire face of said hard metal chips can be used for crushing.

4. An impact crushing machine, comprising:

a casing;

a rotor mounted for rotation on a main shaft extended within said casing;

a plurality of strikers fixedly attached to the circumference of the rotor, to crush and send flying rocklike pieces by respective extremities of said strikers;

an impact plate liner extended around the rotor at a predetermined distance from the rotor, to crush and repulse rocklike pieces sent flying by the strikers;

a plurality of seats, said seats being arranged axially of the rotor in a row on the extremity of each striker and removably fixed to the extremity of each striker; and a plurality of hard metal chips fixed, respectively, to each of said seats, wherein said hard metal chip is joined to said seat removably attached to the extremity of the body of said striker, and at least a contact surface between the seat provided on the radially outer line and said hard metal chip joined to said seat is inclined toward the direction of rotation of said rotor at an angle in the range of 3° to 25°.

* * * * *

UNITED STATES PATENT AND TRADEMARK OFFICE

CERTIFICATE OF CORRECTION

PATENT NO. : 4,871,119

DATED : Oct. 3, 1989

INVENTOR(S) : Hiroyuki Murata, et al

It is certified that error appears in the above-identified patent and that said Letters Patent is hereby corrected as shown below:

The total number of drawing sheets is incorrectly recorded, "15", should be:

--19--

Signed and Sealed this

Twenty-fifth Day of September, 1990

*Attest:*

HARRY F. MANBECK, JR.

*Attesting Officer*

*Commissioner of Patents and Trademarks*